United States Patent [19]

Justus

[11] Patent Number: 4,536,255

[45] Date of Patent: Aug. 20, 1985

[54] EXTENDED NIP PRESS

[75] Inventor: Edgar J. Justus, Beloit, Wis.

[73] Assignee: Beloit Corporation, Beloit, Wis.

[21] Appl. No.: 558,837

[22] Filed: Dec. 7, 1983

[51] Int. Cl.[3] ..... D21F 3/00; D21F 3/04; D21F 3/08

[52] U.S. Cl. ..... 162/358; 100/121; 100/153; 100/154; 162/205; 162/361

[58] Field of Search ..... 162/358, 360, 361, 205; 100/118, 121, 153, 154

[56] References Cited

U.S. PATENT DOCUMENTS

| | | | |
|---|---|---|---|
| 3,293,121 | 12/1966 | Martin | 162/358 |
| 3,808,096 | 4/1974 | Busker et al. | 162/358 |
| 4,201,624 | 5/1980 | Mohr et al. | 162/205 |
| 4,287,021 | 9/1981 | Justus et al. | 162/358 |
| 4,308,096 | 12/1981 | Cronin | 162/360.1 |
| 4,425,190 | 1/1984 | Cronin | 162/361 |
| 4,431,045 | 2/1984 | Josefsson | 162/205 |

*Primary Examiner*—S. Leon Bashore
*Assistant Examiner*—K. M. Hastings
*Attorney, Agent, or Firm*—Hill, Van Santen, Steadman & Simpson

[57] ABSTRACT

An extended nip press having a press nip formed between a first press roll and a looped traveling belt wrapping a portion of the roll with the belt having a shaped mandrel therein with a concave surface conforming to the roll facing the nip and a concave surface facing away from the nip conforming to a support roll with lubricant between the mandrel and belt and the rolls having a deflection control means with the mandrel being self-positionable during operation of the press.

3 Claims, 2 Drawing Figures

EXTENDED NIP PRESS

BACKGROUND OF THE INVENTION

The invention relates to improvements in presses for pressing liquid from a traveling fibrous web, and more particularly to an improved extended nip press which extracts water from a traveling paper web.

In a conventional papermaking machine after the web is formed, it is carried through a press section where the water is mechanically expressed from the fibrous web. Improvements in press sections have included changes from the conventional two roll press to what is known as an extended nip press when the web is subjected to a continuing pressure for a longer period of time in each press nip than with a simple two roll press. Developments in these extended nip presses have included a roll as one of the pressing members with the other pressing member being a continuous impervious belt pressed toward the roll by an arcuate sliding shoe which develops a film of dynamic hydraulic fluid between the belt and shoe to eliminate friction and thus help aid in developing uniform pressure completely across the pressing zone through which the web presses. An example of such improved shoe press is shown in U.S. Pat. No. 3,783,097, E. J. Justus. In present high speed papermaking machines, the press must be capable of high nip pressures and of operating continuously and reliably over relatively long operating periods without the necessity of shutting down the operation. An important objective in any pressing operation is to obtain uniform extraction of water across the width of the nip. The uniform extraction is a direct function of the uniform pressure. In all paper machines, and particularly those of wide width, the bending caused by the application of forces must be compensated for so that forces in the center of the web are the same as at the edges.

It is accordingly an object of the present invention to provide an improved extended nip press which is capable of an improved pressing operation, and particularly is capable of producing uniform water extraction by the application of uniform pressure along the nip length.

A further object of the invention is to provide an improved extended nip press which is of a simplified construction so that manufacturing costs are reduced, so that the complexity of operating parts is minimized, and the structure is capable of continued high speed operation without wear of parts.

A further object of the invention is to provide an improved extended nip press capable of avoiding contamination to the web by the oil used in the parts being prevented from reaching the web because of the nature of the structure.

Other objects, advantages, and features will become more apparent with the teaching of the principles of the invention in connection with the disclosure of the preferred embodiments in the specification, claims and drawings, in which:

DESCRIPTION OF THE PREFERRED EMBODIMENT

Figure 1:
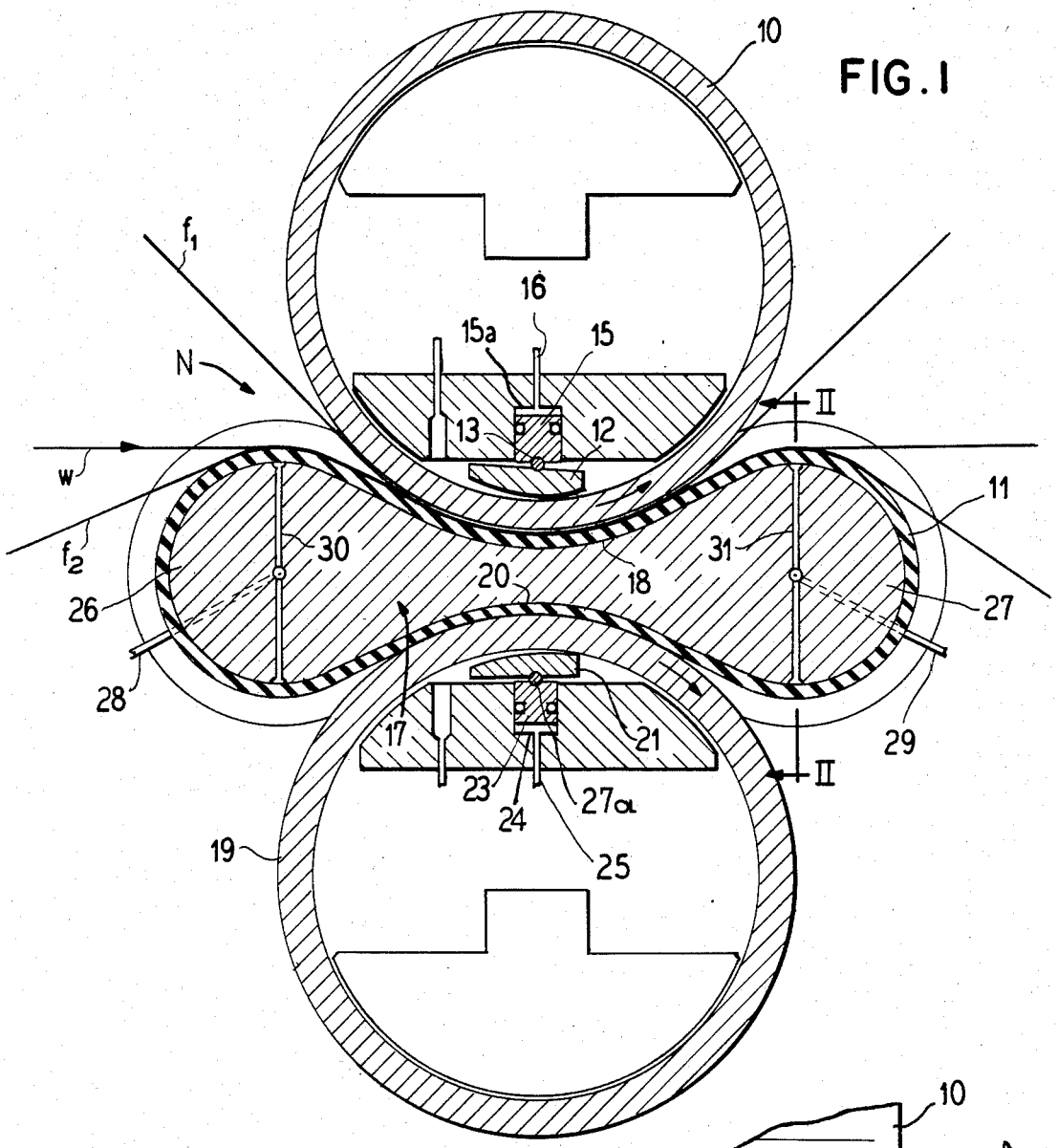
FIG. 1 is a side elevational view of a press section of a papermaking machine having an extended nip press constructed and operating in accordance with the principles of the present invention.

As illustrated in the drawings, the press has a nip N into which the web W passes with means for receiving the water pressed from the web in the means of felts $F_1$ and $F_2$. The nip is defined between a press roll 10 and an endless or looped belt 11. As the web passes into the nip N, it is pressed during the time of the contact where the belt 11 wraps the press roll 10. The water pressed from the web passes into the felts $F_1$ and $F_2$. The felts are looped and pass through a felt drier before re-entering the nip. In some circumstances, it may be desirable to provide only one felt, such as $F_2$ with the web then being in contact with the roll 10, and being separated from the roll by a doctor on the offrunning side. It is also possible instead to omit the felt $F_2$ so that the web passes into the nip with the felt $F_1$ and the web is separated from the belt 11 on the offrunning side of the nip. In this construction, it may desirable to provide a press roll 10 with grooves on the upper surfaces for aiding in the expression of water from the web with the water passing more easily into the felt and into the grooves.

Thus, the nip is formed between first and second members, the first member being the roll shell 10, the second member being the belt 11. Within the belt, is a shaped solid support means or mandrel 17 which extends in a cross-machine direction, and essentially is of a size to fill the inside of the belt 11. The mandrel has a concave upper surface 18 which is shaped to substantially conform to the circumferential shape of the press roll 10. Thus, as the web enters the nip N, a substantially uniform pressure is applied for its travel through the distance that the belt wraps the press roll.

Means are provided for applying the pressing force to the nip which include a support means in the form of a roll shell 19. The mandrel is concave on its lower surface 20 to essentially conform to the shape of the support roll 19. The ends of the mandrel 26 and 27 are thicker or larger than its center portion so that the mandrel and belt are held in their position between the rolls. The mandrel is free to move in a machine direction and is restrained only in a cross-machine direction so that the mandrel and belt are thus self-locating relative to the nip.

An arrangement is provided for lubricating the belt in its movement over the stationary mandrel, and for this purpose, oil delivery lines 28 and 29 connect to passages 30 and 31 within the mandrel. The passages have suitable oil dispersion openings throughout their length so that oil is uniformly dispensed across the width of the machine so as to keep the belt continually lubricated on the mandrel. The mandrel, of course, is finished with a smooth surface to reduce the friction of the belt sliding thereover.

Figure 2:
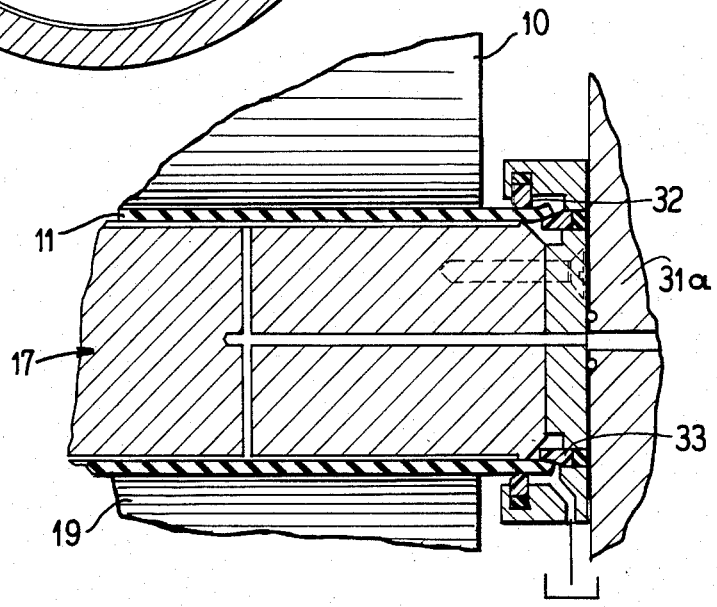
FIG. 2 is a vertical sectional view taken substantially along line II—II of FIG. 1.

As shown in FIG. 2, an end support **31*a* is provided which holds the mandrel in its location in a cross-machine direction, and the end support is smooth so as to permit self-locating movement of the mandrel in the machine direction. Seals 32 and 33 are provided to prevent leakage of the oil from the area between the belt and mandrel, and a certain amount of oil will leak past the seals which is replaced by the continual supply of oil supplied through the lines 28 and 29**.

The lower support roll 19 is preferably provided with a deflection control means as is the upper roll. The upper roll is a roll shell and has within it a sliding shoe 12 with a convex outer surface and oil is maintained within the roll shell so that a film of dynamic lubricating oil builds up between the shoe 12 and the inner surface of the roll shell 10. The shoe is mounted on a cross-machine direction pivotal roll pin 13 which is supported on the top of a piston 15 within a cylinder 15*a* which is supplied with pressurized oil through a supply line 16.

The support roll shell 19 is similarly supported with a sliding hydraulic bearing shoe 21 engaging the inner surface of the roll shell which has a film of oil therein to maintain a dynamic film of oil between the shell and shoe. The shoe is supported on a roll pin 27*a* on a piston 23. The piston is mounted in a cylinder 24 supplied with pressurized oil through a supply line 25.

With the arrangement shown, both roll shells are supported by pressurized liquid within the cylinders 15*a* and 24 so that inasmuch as the liquid under pressure exerts a uniform pressure along the length of the roll, the roll shells will remain straight and will not bend along the nip. This prevents any bending stresses in the roll or in the sliding shoes 12 and 18 from introducing additional pressing forces at the ends or in the center which would tend to cause inequality in the pressing force between the ends and the center of the nip.

In some constructions, it may be desirable to omit the deflection control means within the roll shell in one of the shells and to make that roll a conventional solid roll supported on axles on the end. This will cause bending along the nip, but in certain operations, this may not be objectionable.

Inasmuch as the shoe and its belt are self-locating within the nip, the system operates in a balanced manner, and no spurious or transient pressure forces will occur in the nip due to stresses on the material. Further, the structure is relatively simple in construction so as to reduce construction costs.

The arrangement is shown operating in a horizontal position, but it will be understood that the nip can be arranged vertically with the web traveling either downwardly into the nip or upwardly into an uprunning nip.

It also may be desirable if a double pressing operation is desired to thread the web over guide rolls in a reverse travel to pass it through the nip formed between the support roll 19 and the belt 11 in which case an additional felt is run through that nip.

The structure is capable of providing in a more reliable fashion a clean web in that the oil is isolated within the impervious belt and does not have a chance of getting onto the web. The belt is of the construction known to the art and used in various extended nip presses, and may be of a material shown and described in U.S. Pat. Nos. 4,238,287 or 4,229,254.

In operation, the rolls preferably are both driven in rotation, although the drive may be applied to only one of the rolls, and the web travels into the nip. As it enters a nip, pressure is applied between the belt 11 and the press roll 10 with the web being subjected to dewatering pressure during the entire time it is traveling the path over which the belt 11 wraps the portion of the roll 10. Pressing force for the nip is applied by the forces applied to the roll 10, and the force applied by the roll 19 transmitted through the belt portion traveling in contact with its surface and through the mandrel and through the belt portion facing the press nip N. Lubricant is continually fed into the surfaces between the mandrel and the belt for free travel of the belt over the mandrel, and the mandrel is self-positionable. Since the upper surface of the mandrel facing the nip is shaped with substantially the same radius or the same conformation as the outer surface of the roll 10, the pressure will be substantially uniform throughout the travel of the web through the nip, and no induced bending or other forces will occur to create nonuniform pressure at different locations along the nip. Also, since the nip line is essentially straight in a cross-machine direction, with each of the roll shells being held straight by their deflection control means within the roll shell, no unequal forces to cause unequal pressing pressures will be caused by bending of the mandrel.

Thus, it will be seen that I have provided an improved extended nip press arrangement which meets the objectives and advantages above set forth and is capable of providing improved dewatering in a papermaking machine.

I claim as my invention:

1. A press mechanism for removing liquid from a traveling fibrous web comprising in combination:

a press nip formed between first and second members for receiving a traveling fibrous web therebetween;

the first of said members being a cylindrical press roll;

the second member being an endless belt wrapping a portion of the roll to form the nip;

a mandrel within the belt essentially of a size to fill the inside of the belt, said mandrel directly supporting the entire belt, and extending in a cross-machine direction and having a center portion with a first concave surface facing the nip and having a second concave surface opposite the first surface and having its ends thicker than the center portion;

means for providing lubricant between the mandrel and the belt;

means for receiving liquid pressed form the web in the nip;

a support roll in running engagement with the belt opposite the nip at said second concave surface with forces between the press roll and support roll providing pressing force within the nip;

and means defining lubricant delivery passages extending through the mandrel and opening from the mandrel surface to provide said means for supplying lubricant between the mandrel and belt.

2. A press mechanism for removing liquid from a traveling fibrous web comprising in combination:

a press nip formed between first and second members for receiving a traveling fibrous web therebetween;

the first of said members being a cylindrical press roll;

the second member being an endless belt wrapping a portion of the roll to form the nip;

a mandrel within the belt essentially of a size to fill the inside of the belt, said mandrel directly supporting the entire belt, and extending in a cross-machine direction and having a center portion with a first concave surface facing the nip and having a second concave surface opposite the first surface and having its ends thicker than the center portion;

means for providing lubricant between the mandrel and the belt;

means for receiving liquid pressed from the web in the nip;

a support roll in running engagement with the belt opposite the nip at said second concave surface with forces between the press roll and support roll providing pressing force within the nip;

means defining lubricant delivery passages extending through the mandrel and opening from the mandrel surface to provide said means for supplying lubricant between the mandrel and belt;

and each of said rolls being hollow roll shells and being provided with liquid supported deflection control means within the roll shell for applying uniform force to the rolls along the length of the nip thereby preventing bending along the nip.

3. A press mechanism for removing liquid from a traveling fibrous web comprising in combination:

a press nip formed between first and second members for receiving a traveling fibrous web therebetween;

the first of said members being a cylindrical press roll;

the second member being an endless belt wrapping a portion of the roll to form the nip;

a mandrel within the belt essentially of a size to fill the inside of the belt, said mandrel directly supporting the entire belt, and extending in a cross-machine direction and having a center portion with a first concave surface facing the nip and having a second concave surface opposite the first surface and having its ends thicker than the center portion;

means for providing lubricant between the mandrel and the belt;

means for receiving liquid pressed from the web in the nip;

a support roll in running engagement with the belt opposite the nip at said second concave surface with forces between the press roll and support roll providing pressing force within the nip;

means defining lubricant delivery passages extending through the mandrel and opening from the mandrel surface to provide said means for supplying lubricant between the mandrel and belt;

and said mandrel within the belt having the first and second concave surfaces facing the rolls and having a portion at the lead end of the nip of a thickness larger than the distance between the rolls at the nips so that the belt and mandrel are self-positionable during rotation of the rolls.

* * * * *